US005867098A

United States Patent [19]

Angel et al.

[11] Patent Number: 5,867,098

[45] Date of Patent: Feb. 2, 1999

[54] CIRCULAR MAGNETIC TARGET FOR AN ELECTRONIC ARTICLE SURVEILLANCE SYSTEM

[75] Inventors: Willem Angel, Zwolle; Henri Batterink, Aalden; Cornelis Simon Adriaan De Nood, Harderwijk, all of Netherlands

[73] Assignee: Dutch A&A Trading B.V., Harderwijk, Netherlands

[21] Appl. No.: 656,297

[22] PCT Filed: Dec. 8, 1994

[86] PCT No.: PCT/NL94/00312

§ 371 Date: Jun. 27, 1996

§ 102(e) Date: Jun. 27, 1996

[87] PCT Pub. No.: WO95/16981

PCT Pub. Date: Jun. 22, 1995

[30] Foreign Application Priority Data

Dec. 13, 1993 [NL] Netherlands ..... 9302171

[51] Int. Cl.[6] ..... G08B 13/187

[52] U.S. Cl. ..... 340/551; 340/572

[58] Field of Search ..... 340/572, 551

[56] References Cited

U.S. PATENT DOCUMENTS

| | | | |
|---|---|---|---|
| 4,074,249 | 2/1978 | Minasy | 340/572 |
| 4,075,618 | 2/1978 | Montean | 340/572 |
| 4,825,197 | 4/1989 | Church et al. | 340/572 |
| 4,829,288 | 5/1989 | Eisenbeis | 340/551 |
| 4,849,736 | 7/1989 | Cordery | 340/551 |
| 4,967,184 | 10/1990 | Regelsberger | 340/551 |
| 5,182,544 | 1/1993 | Aquilera et al. | 340/572 |
| 5,406,264 | 4/1995 | Plonsky et al. | 340/572 |

FOREIGN PATENT DOCUMENTS 0 260 831 3/1988 European Pat. Off. .

*Primary Examiner*—Glen Swann
*Attorney, Agent, or Firm*—Young & Thompson

[57] ABSTRACT

A transmitter produces a magnetic alternating field having a predetermined frequency. A receiver is provided with a detector which is able to detect predetermined higher harmonics of the frequency of the alternating field. A transponder includes a signal element made of soft magnetic material. When the transponder is placed in the magnetic alternating field, higher harmonics of the frequency of the alternating field are generated by the signal element. The signal element is in the form of a ring.

19 Claims, 3 Drawing Sheets

CIRCULAR MAGNETIC TARGET FOR AN ELECTRONIC ARTICLE SURVEILLANCE SYSTEM

BACKGROUND OF THE INVENTION

The invention relates to a transponder for a detection system, which comprises a transmitter, for the production of a magnetic alternating field having a predetermined frequency, and a receiver, the transponder comprising a signal element made of soft magnetic material and the receiver being provided with a detector which detects the higher harmonics of the frequency of the alternating field, which harmonics are generated by placing the transponder in the magnetic alternating field, in which the signal element has a curved shape. A transponder of this type is disclosed in U.S. Pat. No. 4,074,249.

The known detection system comprises a transmitter which is composed of an alternating voltage generator and a coil unit connected thereto in order to generate a magnetic alternating field having a predetermined frequency. In addition, the detection system comprises a receiver, the receiving coil unit of which is placed opposite the transmitting coil unit of the transmitter. The receiving coil unit is connected to a detector of the receiver, which is set up to detect higher harmonics of the frequency of the alternating field. The known transponder for use in the known system comprises a carrier of insulating plastic material, on which a curved strip made of soft magnetic material is fixed.

When the transponder is located in the magnetic alternating field, it will be influenced by said field in such a way that harmonics of the frequency of the alternating field are generated, which harmonics are detected by the detector as an indication of the presence of the transponder in the magnetic alternating field.

The curved signal element used in the above known system provides a relatively good signal response over a wide range of orientation of the plane of the signal element in comparison to a straight element, but has the disadvantage that the detection is still direction-sensitive perpendicular to the abovementioned plane.

When the signal wire is positioned with its longitudinal direction perpendicular to the lines of force of the magnetic alternating field, no higher harmonics of the frequency of the alternating field are generated, or the amplitudes of said higher harmonics are too small to enable them to be detected. The detection system therefore works reliably only when the signal carrier has a specific orientation with respect to the magnetic alternating field.

SUMMARY OF THE INVENTION

The aim of the invention is to provide a transponder of the type mentioned in the preamble, with which the abovementioned disadvantage is avoided and as minimal as possible dimensions are possible while sufficient signal is still produced.

This aim is achieved according to the invention in that the signal element has a shape of a closed or open circle.

One skilled in the art would expect that by using a closed loop for the signal element the slightly direction-insensitive result in the plane of the signal element will be eliminated.

However, it has been found surprisingly that as a result of the circular shape of the signal element of the invention the detection of the presence of said signal is direction-insensitive in any direction with respect to the generated magnetic field.

The known elongated signal elements in the form of a straight or slightly curved strip have to be of a minimum length in order to be able to achieve reliable detection. The invention has the advantage that the maximum length of the transponder can be smaller because of a kind of unexpected resonance effect.

In addition, the invention has the advantage that the pattern of the frequency spectrum of the signal received by the receiver is constant as a function of the distance away from the aerial. Only the amplitude of the harmonics becomes proportionally smaller as the distance increases.

By application of the invention, a greater port width can also be used, that is to say the transmitting and receiving coil units can be placed a greater distance apart without the reliability of the detection becoming unacceptable.

The invention also has the further advantage that a number of harmonics are stronger than the others, so that a frequency-selective measurement can be carried out, with, as a result, a detection system which is less noise-sensitive.

In the European Patent Application 0 260 831 and the U.S. Pat. Nos. 4,025,197 and 4,075,618 signal elements or markers are disclosed in which the so-called flux collectors are used. A flux collector is a surface of soft magnetic material, between which an intermediate strip material is provided. The function of the flux collector is the collection of magnetic field lines and to direct that field lines through the intermediate strip material and to bring that strip material in saturation. Consequently, the signal production is increased in comparison to a straight strip. The disadvantage of this principle is the direction-sensitivity. According to the abovementioned patent publications a number of elements each consisting of two flux collectors and an intermediate strip material, are positioned in a hexagonal configuration, by which the direction-sensitivity could be limited slightly, however, only in one plane. A further disadvantage of said principle is that the area of the flux collectors is decreased. In order to obtain the same signal production the marker must have larger dimensions, by which, however, the direction-sensitivity increases.

In contrast the circular signal element of the invention could have smaller dimensions with the same signal production, while the simple shape has its advantage in the fabrication of the marker.

Various embodiments of the signal element according to the invention are described in the subsidiary claims.

BRIEF DESCRIPTION OF THE DRAWINGS

The invention will be explained in more detail below with reference to the drawings. In the drawings.

DESCRIPTION OF PREFERRED EMBODIMENT

Figure 1:
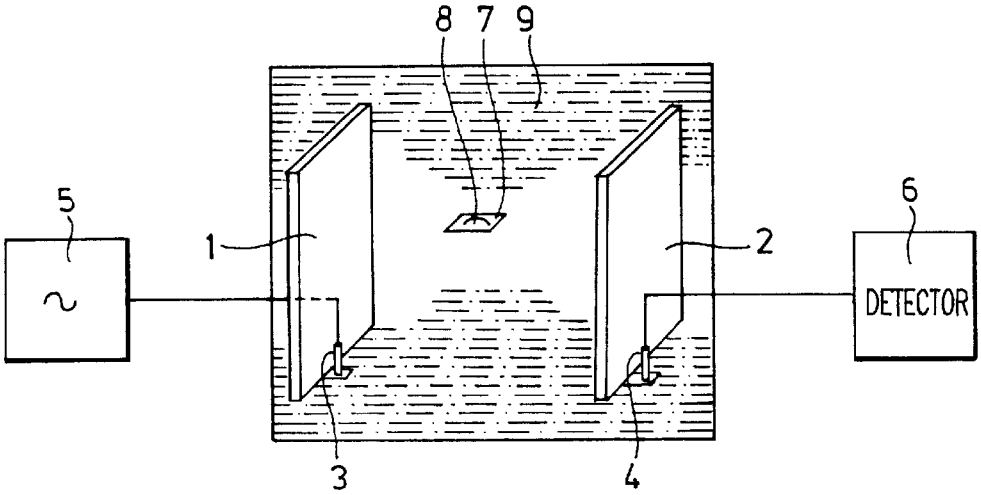
FIG. 1 shows a diagrammatic representation of a detection system having a transponder according to the invention.

FIG. 1 shows a known detection system diagrammatically. This detection system comprises a transmitter for generating an alternating magnetic field and a receiver for receiving distortions in the magnetic alternating field. In principle, the transmitter is composed of a transmitting coil unit 1 having a connection 3, which is indicated diagrammatically, and an alternating voltage generator 5. Said alternating voltage generator 5 is connected, optionally with the use of an amplifier, to the connection 3 of the transmitting coil element 1. In the space 9, a magnetic alternating field which has, for example, a frequency of 300 Hz or higher is generated by the transmitter by electromagnetic means.

The detection system also comprises a receiver, which in principle is composed of a receiving coil unit 2 which has a connection 4 and a detector 6. The detector 6, which is connected to the connection 4 of the receiving coil unit 2, is set up to detect one or more predetermined harmonics of the frequency of the alternating field.

The transmitting coil unit 1 and receiving coil unit 2, which are placed opposite one another, define, in the space 9, a port having a specific port distance. It is, of course, possible to place the receiving coil unit in the same plane as the transmitting coil unit, for example within or around the transmitting coil unit.

The transponder according to the invention, which is composed of a carrier or substrate 7 made of insulating plastic material, on which an elongated signal element 8 having a curved shape is fixed, is used in said detection system. Said signal element can be composed of a strip or wire made of magnetic soft material. This material is preferably amorphous, but can also be crystalline.

When the said transponder is introduced in the port, as shown in FIG. 1, that is to say between the two coil units 1 and 2, the magnetic alternating field is influenced by the signal element in such a way that higher harmonics of the frequency of the alternating field are generated. Said harmonics are detected via the receiving coil unit 2 by the detector 6.

A detection system of this type is used, for example, at shop exits to counteract shoplifting. However, the transponder according to the invention can equally well be used in other types of detection systems in which a magnetic alternating field is generated and the distortion of the magnetic field produced by the signal element is detected.

It has been found that, in contrast to known transponders having a straight or curved signal wire or strip, the orientation of the transponder having a circular signal element is not important. The transponder according to the invention can also be detected when this is rotated through 90° in the plane shown in FIG. 1, but also when the plane of the transponder is rotated through 90°. It is thus not possible for the transponder to be in any orientation where no detection can take place.

It is known that in the case of the known straight signal elements a minimum length is needed in order still to be able to detect reliably. However, in the case of the transponder according to the invention the minimum length is smaller than that of the known transponders. This is important especially when smaller articles on which a transponder has to be used have to be detected.

The said advantage of the invention manifests itself in particular in the embodiments shown in FIGS. 2 to 5.

Figures 2, 3, 4:
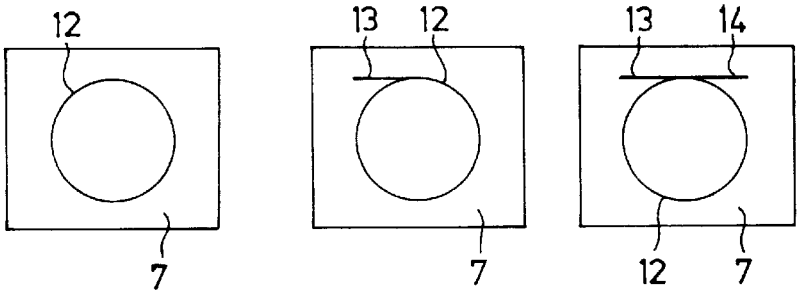
FIGS. 2, 3, and 4 show embodiments of the signal element of the transponder according to the invention.

FIG. 2 shows a circular signal element on the substrate 7. In this case the circle is closed; however, the circle can also be interrupted at one or more locations, two free ends located some distance apart then being obtained at every interruption.

The embodiment of the signal element shown in FIG. 3 is composed of a circular component 12 and a straight sub-element 13, which is in contact with the circle 12. The straight sub-element 13 is tangent to the circle 12, and 2 or more sub-elements can also be used, which sub-elements can extend from the same point or from various points on the circle 12. It is found surprisingly that the signal production of this element is improved.

FIG. 4 shows an embodiment of the signal element according to the invention which is preferably to be used, which element is composed of a circular sub-element 12 and two straight sub-elements 13 and 14. Although said sub-elements 13 and 14 are tangent to the circle 12, slightly different orientations of the sub-elements are also possible.

The signal elements shown as a line in FIGS. 2, 3, and 4 can be composed of strip-shaped bands of soft magnetic material arranged on the substrate 7, for example by vapour-deposition.

The signal elements shown in FIGS. 2, 3 and 4 can, however, most simply be produced from a soft magnetic wire, which is curved in the forms shown and is fixed to the substrate, for example by gluing or other possibilities, and, if desired, is covered by an insulating protective layer. The curved wire can make contact or can be insulated at the intersection of the overlapping wire portions.

Furthermore, it is also conceivable to provide the circular sub-element 12 with more than two straight sub-elements 13 and/or 14.

Table A below shows the measured harmonic signals for various dimensions of the signal element according to FIG. 4 for various positions of said element at a determined transmitting frequency. The first numeral in the column "dimensions" is the diameter and the second numeral is the total length of the straight sub-elements 13, 14. Pos 1 indicates that the signal element assumes a position in the magnetic alternating field such that the plane of the signal element is parallel to the lines of force of the magnetic alternating field, whilst the longitudinal direction of the straight sub-elements 13, 14 is also parallel to the said lines of force. For Pos 2, the plane of the signal element is parallel to the lines of force, but the longitudinal direction of the straight sub-elements 13, 14 is perpendicular to said lines of force. Furthermore, Pos 3 indicates that the plane of the signal element is perpendicular to the lines of force.

The measurements were carried out using a measuring distance of 25 cm.

Known straight signal elements. i.e. Esselte Meto 32 and Check Point 37, are also included in the table.

It can clearly be seen from the table that the signal elements according to the invention are much less direction-sensitive than are the known straight elements.

Furthermore, it can also be deduced from the table that a signal element measuring 18×18 mm has the best signal-dimension ratio at a determined transmitting frequency.

Figure 5:
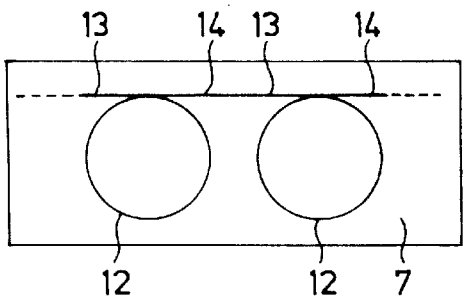
FIG. 5 shows a number of signal elements according to FIG. 4 coupled in series.

FIG. 5 shows an embodiment in which a number of circular sub-elements 12 are coupled in series via the straight sub-elements 13 and 14.

Figure 9:
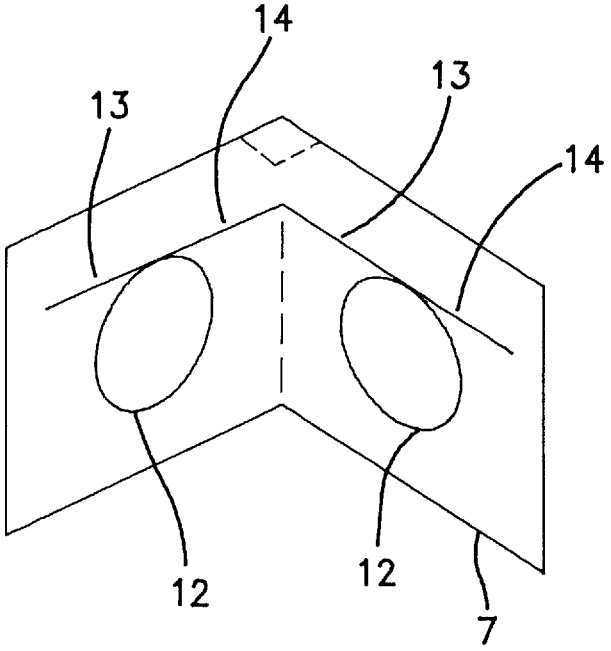
FIG. 9 shows an embodiment of a 3-D transponder of the present invention.

It is also possible, in manner such as shown in FIG. 9, to arrange two separate signal elements perpendicular to one another in a transponder, so that so-called 3-D detection is possible.

It can also be seen from the table that the 14th harmonic and adjacent harmonics are pronounced in comparison with the other harmonics. This seems to result from a surprising special resonance effect caused by the shape of the signal element of the invention. Thus the advantage is achieved that the measurement can be carried out highly frequency-selectively, as a result of which fewer problems with noise are experienced.

Furthermore, the signal element according to the invention also has the advantage that the frequency spectrum of the signal which is received and detected by the receiver composed of the detector 6 and the receiving coil unit 2 is constant as a function of the distance from the transmitting and/or receiving coil unit. Only the amplitude of the harmonics becomes proportionally smaller as the distance increases.

It has also been found that a greater port width between the transmitting coil unit and receiving coil unit can be used than is possible with the known straight signal elements.

Figure 6:
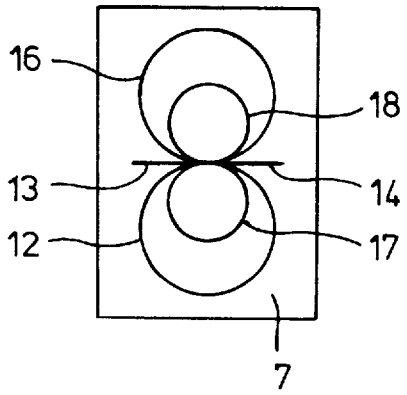
FIG. 6 shows two signal element configurations according to the invention coupled in parallel.

FIGS. 2–5 show signal elements composed of one circular component or two circular components. Signal elements having more than two circular sub-elements also fall within the scope of the invention. An embodiment of this type is illustrated by way of example in FIG. 6. In this case the signal element also comprises, in addition to the circular sub-element 12 and the straight sub-elements 13 and 14, a circular sub-element 16. This configuration can be regarded as a so-called parallel coupling of two signal elements according to FIG. 4. Another possible embodiment of the invention is a supplementary circular sub-element 17, which has a smaller diameter and is located inside the sub-element 12. This possibility can be used per se. FIG. 6 shows the so-called parallel coupling of two configurations, which is composed of the supplementary circular sub-elements 16, 17 and 18. Further supplementary measures and configurations, of course, also fall within the scope of the invention.

Figure 7:
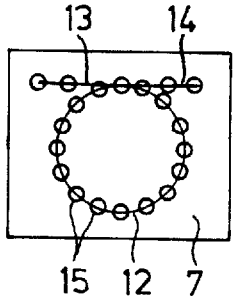
FIG. 7 shows a deactivatable signal element according to FIG. 4.

FIG. 7 shows yet a further embodiment of the signal element according to the invention, which signal element is deactivatable. To this end, a number of islands 15, which are composed of a magnetisable hard material, are arranged along the signal element 12, 13 and 14 and insulated therefrom. When said islands are magnetised by means of a magnetic field, the signal element 14 is deactivated and therefore gives no detection. For production reasons it is also advantageous to distribute the islands randomly over the substrate 7 and, of course, this deactivation method applies for every embodiment of a signal element according to the invention.

By using the above constructions it is possible to obtain a signal production of selected harmonic signals for creating thereby an implementation in the identification technic.

Figure 8:
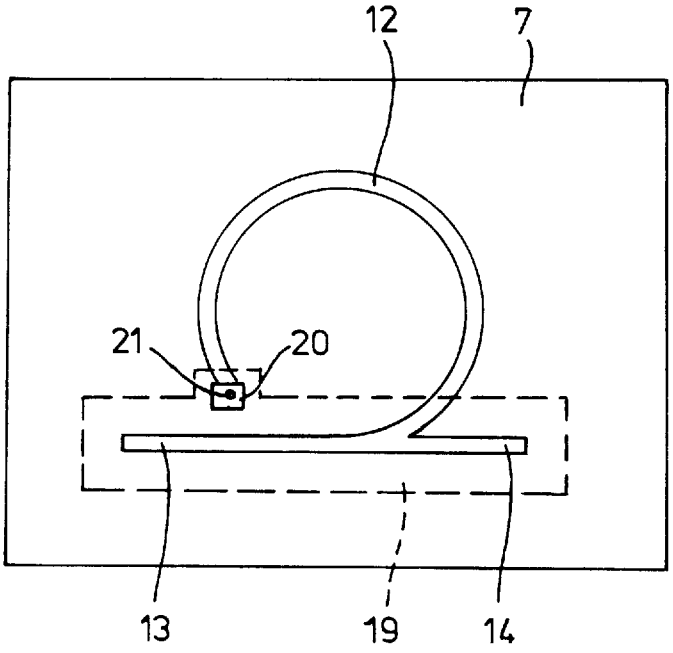
FIG. 8 shows an embodiment of the transponder according to the invention suitable for EM and RF detection.

FIG. 8 shows a transponder which is suitable for electromagnetic detection including radio frequency detection, hereinafter termed EM and RF detection respectively.

A signal element for EM detection, which is composed of the circular sub-element 12 and the straight sub-elements 13 and 14, is arranged on one side of the substrate 7 of electrically insulating material. A surface 19 of electrically conducting material is applied to the other side for RF detection, which surface is connected through the substrate to the surface 20 of the sub-element 12 via a through-contact 21. The signal element 12, 13 and 14 represents a self-inductance which is connected in series to the capacitor which is composed of the sub-elements 13 and 14 as the one capacitor surface and surface 19 as the other capacitor surface. Said self-inductance and capacitor consequently form a resonance circuit for RF detection.

By means of said transponder which has been described, a universal transponder in obtained which is independent of the system used. Of course, diverse configurations of signal elements according to the invention are possible in a transponder of this type.

TABLE A

| Dimensions and position | Harmonic signals 10° | 11° | 12° | 13° | 14° | 15° | 16° | 17° | 18° | 19° | 20° |
|---|---|---|---|---|---|---|---|---|---|---|---|
| 16 × 26 Pos 1 | 0 | 0 | 0 | 4 | 4 | 1 | 1 | 0 | 0 | 0 | 1 |
| 16 × 26 Pos 2 | 0 | 0 | 0 | 7 | 5 | 8 | 5 | 5 | 3 | 1 | 0 |
| 16 × 26 Pos 3 | 0 | 0 | 2 | 5 | 8 | 6 | 7 | 1 | 3 | 4 | 1 |
| Esselte | | | | | | | | | | | |
| Meto 32 Pos 1 | 0 | 0 | 0 | 7 | 5 | 6 | 4 | 5 | 4 | 4 | 3 |
| Meto 32 Pos 2 | 0 | 0 | 0 | 0 | 0 | 0 | 0 | 0 | 1 | 0 | 1 |
| Meto 32 Pos 3 | 0 | 0 | 0 | 0 | 0 | 1 | 0 | 0 | 0 | 0 | 1 |
| Check Point | | | | | | | | | | | |
| 37 Pos 1 | 0 | 0 | 0 | 4 | 3 | 3 | 0 | 1 | 1 | 4 | 4 |
| 37 Pos 2 | 0 | 0 | 0 | 0 | 0 | 0 | 0 | 0 | 1 | 0 | 1 |
| 37 Pos 3 | 0 | 0 | 0 | 0 | 0 | 0 | 0 | 0 | 1 | 0 | 1 |
| 20 × 20 Pos 1 | 0 | 0 | 0 | 8 | 4 | 9 | 0 | 6 | 0 | 5 | 0 |
| 20 × 20 Pos 2 | 0 | 0 | 3 | 3 | 9 | 6 | 8 | 6 | 7 | 6 | 3 |
| 20 × 20 Pos 3 | 0 | 0 | 0 | 3 | 4 | 5 | 6 | 5 | 6 | 5 | 7 |
| 20 × 32 Pos 1 | 0 | 0 | 0 | 3 | 1 | 3 | 2 | 4 | 2 | 2 | 2 |
| 20 × 32 Pos 2 | 0 | 0 | 1 | 6 | 7 | 4 | 7 | 0 | 6 | 1 | 6 |
| 20 × 32 Pos 3 | 0 | 0 | 0 | 0 | 2 | 3 | 1 | 3 | 2 | 5 | 2 |
| 19 × 19 Pos 1 | 0 | 0 | 0 | 8 | 2 | 8 | 0 | 6 | 0 | 1 | 3 |
| 19 × 19 Pos 2 | 0 | 0 | 2 | 7 | 8 | 9 | 8 | 7 | 5 | 4 | 4 |
| 19 × 19 Pos 3 | 0 | 0 | 0 | 6 | 6 | 8 | 6 | 6 | 6 | 5 | 4 |
| 19 × 32 Pos 1 | 0 | 0 | 0 | 8 | 0 | 8 | 1 | 6 | 1 | 2 | 2 |
| 19 × 32 Pos 2 | 0 | 0 | 3 | 3 | 8 | 6 | 7 | 5 | 5 | 3 | 3 |
| 19 × 32 Pos 3 | 0 | 0 | 1 | 5 | 7 | 7 | 7 | 5 | 6 | 3 | 6 |
| 18 × 18 Pos 1 | 0 | 0 | 1 | 4 | 4 | 4 | 1 | 1 | 0 | 0 | 1 |
| 18 × 18 Pos 2 | 0 | 0 | 3 | 6 | 8 | 9 | 7 | 7 | 5 | 5 | 3 |
| 18 × 18 Pos 3 | 0 | 0 | 0 | 6 | 6 | 8 | 6 | 7 | 4 | 4 | 0 |
| 18 × 32 Pos 1 | 0 | 0 | 0 | 5 | 5 | 5 | 5 | 3 | 0 | 1 | 1 |
| 18 × 32 Pos 2 | 0 | 0 | 0 | 4 | 4 | 4 | 4 | 2 | 3 | 2 | 2 |
| 18 × 32 Pos 3 | 0 | 0 | 0 | 3 | 3 | 7 | 4 | 5 | 4 | 5 | 3 |
| 17 × 17 Pos 1 | 0 | 0 | 0 | 5 | 0 | 2 | 0 | 0 | 0 | 0 | 1 |
| 17 × 17 Pos 2 | 0 | 0 | 3 | 5 | 6 | 6 | 1 | 1 | 0 | 1 | 1 |
| 17 × 17 Pos 3 | 0 | 0 | 1 | 7 | 7 | 7 | 6 | 3 | 3 | 0 | 1 |
| 17 × 32 Pos 1 | 0 | 0 | 0 | 7 | 4 | 7 | 0 | 1 | 1 | 1 | 1 |
| 17 × 32 Pos 2 | 0 | 0 | 0 | 4 | 5 | 7 | 4 | 4 | 4 | 4 | 0 |
| 17 × 32 Pos 3 | 0 | 0 | 2 | 6 | 8 | 8 | 8 | 7 | 6 | 4 | 3 |
| 16 × 16 Pos 1 | 0 | 0 | 0 | 4 | 1 | 1 | 0 | 1 | 1 | 1 | 1 |
| 16 × 16 Pos 2 | 0 | 0 | 2 | 8 | 6 | 6 | 2 | 0 | 0 | 1 | 1 |
| 16 × 16 Pos 3 | 0 | 0 | 0 | 6 | 5 | 5 | 5 | 2 | 5 | 2 | 5 |
| 16 × 32 Pos 1 | 0 | 0 | 1 | 6 | 4 | 4 | 1 | 1 | 0 | 1 | 1 |
| 16 × 32 Pos 2 | 0 | 0 | 0 | 7 | 5 | 8 | 3 | 3 | 2 | 0 | 1 |
| 16 × 32 Pos 3 | 0 | 0 | 1 | 7 | 6 | 8 | 5 | 4 | 3 | 4 | 0 |

What is claimed is:

1. Transponder for a detection system, said system comprising a transmitter for the production of an alternating magnetic field having a predetermined frequency and a receiver, the transponder comprising a signal element made of soft magnetic material and the receiver being provided with a detector which detects the higher harmonics of the frequency of the alternating magnetic field, which harmonics are generated by placing the transponder in the alternating magnetic field, wherein the signal element has the shape of a closed ring, and wherein at least one straight sub-element made of soft magnetic material extends from a point on the ring.

2. The transponder according to claim 1, wherein the straight sub-element is tangent to the ring.

3. The transponder according to claim 2, wherein the diameter of the ring is about 18 mm and wherein a total length of the straight sub-element is also about 18 mm.

4. The transponder according to claim 1, further comprising a plurality of said signal elements and wherein each of said signal elements comprises two of said straight sub-elements extending from the same point and wherein said plurality of signal elements are coupled in series by means of said straight sub-elements.

5. The transponder according to claim 1, further comprising two of said signal elements, said two signal elements being essentially perpendicular to one another.

6. The transponder according to claim 1, further comprising a second said signal element of smaller diameter than said first recited signal element and which is arranged inside and in contact with said first recited signal element.

7. The transponder according to claim 1, further comprising islands made of hard magnetisable material having a rounded circumference and adjoining the signal element.

8. The transponder according to claim 1, wherein the signal element is arranged on one side of a substrate composed of insulating material and wherein a surface of electrically conducting material locally connected to the signal element is present on the other side of the substrate.

9. A transponder for a detection system that detects harmonics of a frequency of an alternating magnetic field that are generated by introduction of the transponder into the magnetic field, the transponder comprising:

a signal element of magnetic material in the shape of a closed or open ring; and a straight sub-element of magnetic material extending from said ring.

10. The transponder of claim 9, wherein said straight sub-element is tangent to said ring.

11. The transponder of claim 9, wherein said ring is closed and wherein said straight sub-element has a length which is substantially the same as a diameter of said closed circle.

12. The transponder of claim 9, further comprising a plurality of said signal elements and associated straight sub-elements, each of said plurality of signal elements being connected to an adjacent one of said plurality of signal elements by associated ones of said plural straight sub-elements.

13. The transponder of claim 9, further comprising a plurality of said signal elements and one said straight sub-element that is tangent to each of said plurality of signal elements.

14. The transponder of claim 13, wherein said one sub-element is tangent to each of said plural signal elements at one point on said one sub-element.

15. A transponder for a detection system that detects harmonics of a frequency of an alternating magnetic field that are generated by introduction of the transponder into the magnetic field, the transponder comprising plural signal elements of magnetic material that contact each other, each of said signal elements having a shape of a continuously curved loop.

16. The transponder of claim 15, wherein one of said plural signal elements further comprises two straight end portions extending therefrom.

17. The transponder of claim 16, wherein said two end portions extend substantially tangentially.

18. The transponder of claim 15, wherein two of said plural signal elements are nested one inside the other.

19. The transponder of claim 15, wherein two of said plural signal elements are juxtaposed.

* * * * *